US005341646A

United States Patent [19]

Agrawal et al.

[11] Patent Number: 5,341,646

[45] Date of Patent: Aug. 30, 1994

[54] TRIPLE COLUMN DISTILLATION SYSTEM FOR OXYGEN AND PRESSURIZED NITROGEN PRODUCTION

[75] Inventors: Rakesh Agrawal, Emmaus, Pa.; Jeffrey S. Langston, Weybridge; Paul Rodgers, Woking, both of England; Jianguo Xu, Fogelsville, Pa.

[73] Assignee: Air Products and Chemicals, Inc., Allentown, Pa.

[21] Appl. No.: 92,164

[22] Filed: Jul. 15, 1993

[51] Int. Cl.[5] ..... F25J 3/02

[52] U.S. Cl. ..... 62/25; 62/39; 62/41

[58] Field of Search ..... 62/24, 25, 41, 39

[56] References Cited

U.S. PATENT DOCUMENTS

| | | | |
|---|---|---|---|
| 5,080,703 | 1/1992 | Rathbone | 62/38 |
| 5,163,296 | 11/1992 | Ziemer et al. | 62/24 |
| 5,230,217 | 7/1993 | Agrawal et al. | 62/22 |
| 5,231,837 | 8/1993 | Ha | 62/39 |
| 5,245,832 | 9/1993 | Roberts | 62/41 |
| 5,251,451 | 10/1993 | Xu et al. | 62/25 |
| 5,257,504 | 11/1993 | Agrawal | 62/24 |

OTHER PUBLICATIONS

Latimer, R. E., "Distillation of Air"—CEP—Feb. 1967—pp. 35–59.

*Primary Examiner*—Ronald C. Capossela

*Attorney, Agent, or Firm*—Willard Jones, II; William F. Marsh; James C. Simmons

[57] ABSTRACT

The present invention relates to an improved cryogenic process for the separation of air to produce an oxygen product and a nitrogen product. The present invention employs a distillation column system with three distillation columns, a low pressure column, a medium pressure column and a high pressure column. The improved three column distillation system process comprises: (a) producing an oxygen product with a product purity of less than 98% purity oxygen and producing no argon product; (b) producing a gaseous nitrogen product which represents greater than 35% of the feed air and which is removed from the medium and/or high pressure columns; (c) recovering a major portion of the oxygen product from the low pressure column; and (d) condensing at least a portion of the high pressure nitrogen overhead from the high pressure column by heat exchange against a liquid stream in the medium pressure column and utilizing at least a portion of the condensed portion to provide reflux to the high pressure column.

26 Claims, 2 Drawing Sheets

TRIPLE COLUMN DISTILLATION SYSTEM FOR OXYGEN AND PRESSURIZED NITROGEN PRODUCTION

TECHNICAL FIELD

The present invention relates to a cryogenic process for the separation of air into its constituent components and the integration of that cryogenic air separation process with a gas turbine power generation system.

BACKGROUND OF THE INVENTION

The production of oxygen and nitrogen from atmospheric air is a power intensive process. It is always desirable to reduce the power consumption of such processes. It is particularly true for large plants, when both oxygen and a large fraction of the nitrogen are demanded at pressures much greater than that of the atmosphere. Example of such an application are the Integrated Gasification Combined Cycle and the Integrated Gasification Humid Air Turbine electrical power generation systems. In these systems, high pressure oxygen is needed for gasification of a carbonaceous feedstock, e.g., coal, and high pressure nitrogen can be fed to the gas turbine power generation system to maximize power output, control NOx formation and/or increase its efficiency. The objective of the present invention is to reduce power consumption of cryogenic air separation plants providing products in such applications.

U.S. Pat. No. 5,257,504 proposed a dual reboiler cycle with the lower pressure column working at pressures significantly higher than that of the atmosphere. The dual reboiler cycle results in a significant power saving over a conventional Linde type double column system. This power saving for the dual reboiler cycle is due to the availability of a higher pressure nitrogen stream directly from the cold box. The dual reboiler cycle is suitable for cases in which all of the products of the air separation unit are delivered as products at pressures equal to or higher than those directly available from the cold box. When not all of the nitrogen is needed at such pressures, a stream of the nitrogen byproduct has to be expanded to a lower pressure, typically at a low temperature. The expansion of a large gas flow with a low expansion ratio usually makes such a system inefficient.

On the other hand, a triple column cycle was introduced by Latimer for the high-pressure-air liquid plant (Chemical Engineering Progress, Vol. 63, No. 2, pp. 35–59, 1967). The triple column cycle was designed for complete oxygen recovery as liquid product and nearly complete argon recovery. The cycle has a feed air pressure of 140 psig (10.7 bara) or higher, since the top of the high pressure column is thermally integrated with the bottom end of the medium pressure column, and top end of the medium pressure column is, in turn, thermally integrated with the bottom end of the lower pressure column. In the cycle, oxygen-enriched liquid containing 25% oxygen from the bottom of the high pressure column is fed into the medium pressure column; and crude oxygen liquid bottoms of the medium pressure column containing 35% oxygen is fed to the low pressure column. The cycle is not designed to produce large fractions of feed air as nitrogen at pressures significantly higher than atmospheric. Almost all of the nitrogen is produced at extremely high purity and near ambient pressure from the top of the low pressure column.

The high feed air pressure required for the cycle makes it inefficient for most applications.

There have also been attempts in the prior ad to improve power efficiency by vaporizing at least a portion of the bottoms liquid from the high pressure column by recirculated and boosted-in-pressure nitrogen. For example, in U.S. Pat. No. 5,080,703, a portion of the nitrogen from the low pressure column is boosted in pressure and condensed against a vaporizing portion of the reduced pressure bottoms liquid from the high pressure column of the double column system. U.S. Pat. No. 5,163,296 teaches the condensing of a high pressure nitrogen stream, which is the expander effluent, in the bottoms reboiler of the high pressure column of the double column system.

SUMMARY OF THE INVENTION

The present invention relates to a process for the separation of a compressed feed air stream to produce gaseous oxygen with purity less than 98% and nitrogen with high recoveries comprising:

(a) using three distillation columns consisting of a low pressure column, a medium pressure column which operates at a pressure higher than the low pressure column and a high pressure column which operates at a pressure higher than the medium pressure column;

(b) feeding a portion of the compressed feed air stream to the high pressure column for distillation into a high pressure oxygen-enriched liquid bottoms and a high pressure nitrogen overhead;

(c) feeding at least a portion of the high pressure oxygen-enriched liquid bottoms to the medium-pressure column;

(d) condensing at least a portion of the high pressure nitrogen overhead by heat exchange against a liquid stream of the medium pressure column and using at least a portion of the condensed high pressure nitrogen to provide reflux to the high pressure column;

(e) removing a medium-pressure oxygen-enriched liquid from the medium pressure column at a location below the high pressure oxygen-enriched liquid bottoms feed point and feeding the removed, medium-pressure oxygen-enriched liquid to an intermediate point of the low pressure column for distillation;

(f) producing at least a portion of the oxygen product from the bottom of the low pressure column; and (g) recovering greater than 35% of the feed air flow to the distillation column system as nitrogen product wherein the nitrogen product is recovered from the high pressure column, the medium pressure column or both the high pressure and medium pressure columns.

In the process, the portion of the high pressure nitrogen overhead stream in step (d) is condensed by heat exchange with a liquid at an intermediate location of the medium pressure column. Also, the boilup at the bottom of the medium pressure column can be produced by the condensation of a suitable process stream. The suitable process stream to be condensed can be a nitrogen stream at a pressure higher than that of the high pressure column.

Further, product oxygen can be withdrawn as liquid from the bottom of the low pressure column, and then boiled by heat exchange with a suitable process stream.

Heat exchange can be provided by the total condensation or partial condensation of a portion of the feed air stream. Prior to heat exchange, the product liquid oxygen can be pumped to a higher pressure.

Further, a nitrogen-rich liquid stream can be withdrawn from the medium pressure column at a location above the feed point of the high pressure oxygen-enriched liquid bottoms and can be fed as reflux to the low pressure column, and a gaseous nitrogen product stream can be produced from the top of the medium pressure column. The boilup at the bottom of the low pressure column can be provided by the condensation of a suitable process stream. The condensing process stream can be a nitrogen stream. The condensing nitrogen stream can be a fraction of the nitrogen from the top of the medium pressure column. Also, another nitrogen-enriched stream can be withdrawn as coproduct from an intermediate location of the medium pressure column.

In the process, the medium pressure oxygen-enriched liquid in step (e) can be produced at the bottom of the medium pressure column or from an intermediate location of the medium pressure column. An oxygen product stream can be produced from the bottom of the medium pressure column.

In the process, the nitrogen product produced in step (g) can be returned to an electric power generation system.

DETAILED DESCRIPTION OF THE INVENTION

The present invention relates to an improved cryogenic process for the separation of air to produce an oxygen product and a nitrogen product. The present invention employs a distillation column system with three distillation columns, a low pressure column, a medium pressure column and a high pressure column. The improved three column distillation system process comprises: (a) producing an oxygen product with a product purity of less than 98% purity oxygen and producing no argon product; (b) producing a gaseous nitrogen product which represents greater than 35% of the feed air and which is removed from the medium and/or high pressure columns; (c) recovering a major portion of the oxygen product from the low pressure column; and (d) condensing at least a portion of the high pressure nitrogen overhead from the high pressure column by heat exchange against a liquid stream in the medium pressure column and utilizing at least a portion of the condensed portion to provide reflux to the high pressure column.

Figure 1:
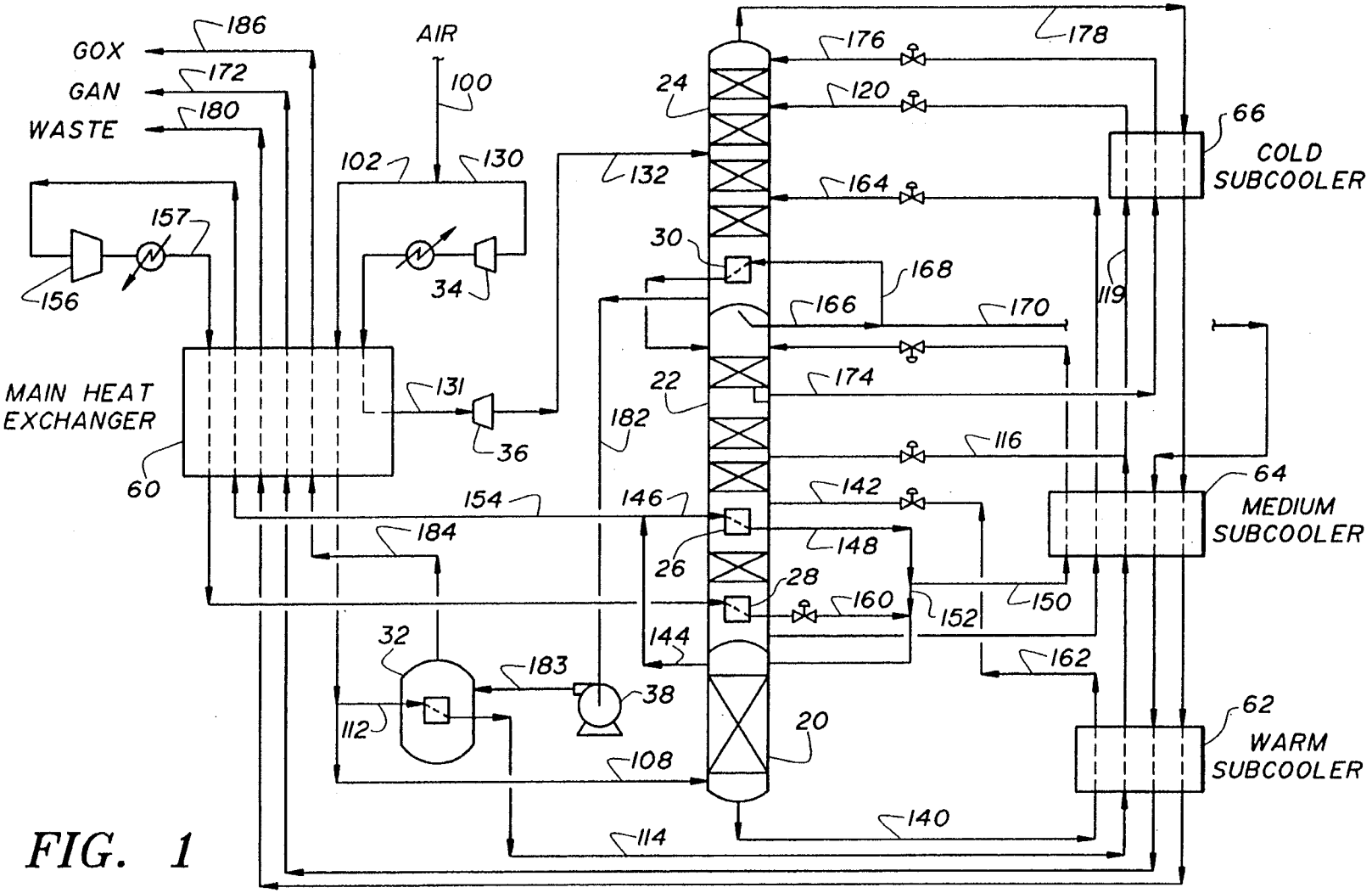
FIGS. 1 and 2 are schematic diagrams of two embodiments of the process of the present invention.

FIG. 1 shows one embodiment of the process of the present invention. With reference to FIG. 1, the feed air, line 100, which is compressed to a pressure greater than 4 bar(a) and is free of carbon dioxide and water, is split into two substreams, lines 102 and 130. The first substream which represents a major fraction of the compressed feed air, line 102, is cooled in heat exchanger 60 to a temperature close to its dew point and then further split into two portions, lines 108 and 112. The first portion, which represents a major fraction of the first substream, line 108, is fed to the bottom of high pressure column 20 for rectification. The second portion, line 112, is condensed against vaporizing pumped liquid oxygen (LOX), line 184, in LOX vaporizer 32. The resulting liquid air, line 114, is subcooled in warm subcooler 62 and medium subcooler 64. The resultant subcooled liquid air is divided into a first liquid air, line 116, which is reduced in pressure and then fed into medium pressure column 22, and a second liquid air, line 119, which is further subcooled in cold subcooler 66, reduced in pressure and fed to low pressure column 24. The second substream, line 130, is boosted in pressure by compander compressor 34, aftercooled and further cooled in main heat exchanger 60. This cooled stream, line 131, is then expanded in expander 36 which is coupled with the compander compressor 34. The expander effluent, line 132, is fed into the middle of low pressure column 24.

The air fed, via line 108, to high pressure column 20 is distilled and separated into a high pressure gaseous nitrogen overhead stream, line 144, and a high pressure bottoms liquid which is enriched in oxygen, line 140. The high pressure nitrogen overhead stream is split into two portions, lines 146 and 154. The first portion, line 146, is condensed in intermediate reboiler/condenser 26 by heat exchange against a liquid descending in the medium pressure column to provide a first high pressure liquid nitrogen stream, line 148. A portion of the first high pressure liquid nitrogen, line 150, is subcooled in medium subcooler 64, reduced in pressure and fed to the top of medium pressure column 22 as reflux. The remaining portion of the first high pressure liquid nitrogen is fed, via line 152, as reflux to the top of high pressure column 20. The second portion, line 154, is warmed in main heat exchanger 60 to ambient temperature, compressed in compressor 156, cooled in main heat exchanger 60, condensed in reboiler/condenser 28 located in the bottom of medium pressure column 22 and fed, via line 160, to high pressure column 20 as the supplemental reflux. The high pressure oxygen-enriched liquid bottoms, line 140, is subcooled in warm subcooler 62, reduced in pressure and fed, via line 142, to the middle of medium pressure column 22.

The oxygen-enriched liquid bottoms from the high pressure column 20 together with the liquid air feed, line 116, is distilled in medium pressure column 22 into a medium pressure gaseous nitrogen overhead, line 166, an impure medium pressure liquid nitrogen stream, line 174, and a medium pressure column bottoms liquid which is further enriched in oxygen to over 40% preferably, over 50% oxygen, line 162. The medium pressure nitrogen overhead stream is divided into two portions, lines 168 and 170. The first portion, line 168, is condensed in reboiler/condenser 30 located in the bottom of low pressure column 24; the condensed portion is returned to the top of medium pressure column 22 as reflux. The second portion of medium pressure nitrogen overhead stream, line 170, is first warmed in subcoolers 64 and 62 and then in main heat exchanger 60 to recover refrigeration and then recovered as a nitrogen product, line 172. The impure liquid nitrogen, line 174, is subcooled in cold subcooler 66, reduced in pressure and fed, via line 176, to the top of low pressure column 24 as reflux. The bottoms oxygen-enriched medium pressure liquid, line 162, is subcooled in middle subcooler 64, reduced in pressure and fed, via line 164, to low pressure column 24.

The liquid air feed, line 120, expander effluent, line 132 and the subcooled bottoms liquid from the medium pressure column, line 164, are distilled in low pressure column 24 into a low pressure nitrogen-rich vapor, line 178, and liquid oxygen, line 182. The low pressure nitrogen-rich vapor, line 178, is removed from the top of low pressure column 24, is warmed in subcooler 66, 64 and 62 and main heat exchanger 60 to recover refrigeration and exits the process as a nitrogen waste stream, line 180. The nitrogen waste, line 180, can be used to regenerate the air cleaning adsorption bed or for other purposes, or be vented into atmosphere after exiting the cold box. The liquid oxygen stream, line 182, is pumped with pump 38 to a higher pressure and vaporized in LOX vaporizer 32 against condensing air, line 112. The high pressure gaseous oxygen, line 184, is warmed close to the ambient temperature in main heat exchanger 60 and subsequently delivered directly, or after further compression, as a gaseous oxygen product to the customer, via line 186.

Several variations of the embodiment shown in FIG. 1 are possible. Although not shown in FIG. 1, any one or more than one of the following may be used:

(1) A portion of the high pressure nitrogen overhead stream, line 154, after being warmed in main heat exchanger 60 may be collected as a product nitrogen stream.

(2) An oxygen product stream may also be withdrawn from the bottom of medium pressure column 22. The purity of this oxygen stream can be different from that of oxygen product, line 182, withdrawn from the bottom of low pressure column 24. In this case, the medium-pressure oxygen-enriched liquid to be fed, via line 164, to low pressure column 24 can optionally be withdrawn from an intermediate location of medium pressure column 22 rather than from the bottom of medium pressure column 22.

(3) A portion of the condensed liquid air stream, line 114, can also be fed as impure reflux to high pressure column 20. Actually, the liquid air, line 114, can optimally be distributed between the three columns as desired.

(4) In the bottom-most reboiler/condenser 28 of medium pressure column 22, an alternate process fluid instead of nitrogen may be condensed to provide bottom boilup. An example of such a fluid can be a portion of the feed air stream. This condensing portion of the feed air stream can be at a pressure which is different than the pressure of high pressure column 20.

(5) The pumped liquid oxygen, line 183, can be optionally vaporized by partial condensation (rather than total condensation) of a portion of the feed air stream.

(6) The boilup at the bottom of low pressure column 24 can be provided by condensing another suitable process stream. Such an example can be a portion of the feed air stream which can be at the needed pressure for total or partial condensation.

(7) Refrigeration for the plant can be provided by the expansion of one or more process streams in one or more expanders. This can be a portion of the feed air stream as shown in FIG. 1. Alternatively, a stream for expansion can be derived from any one of the distillation columns; generally such a stream will be a nitrogen-rich stream even though, if needed, an oxygen-rich stream could also be expanded. All of the recycle nitrogen stream or a portion of it, line 157, can also be expanded for refrigeration.

(8) As an equipment simplication, reboiler/condenser 26, which is located at an intermediate height of medium pressure column 22, can be moved outside the column. For further simplification, the high pressure nitrogen steam, line 146, can be condensed by heat exchange in the external reboiler/condenser 26 against vaporizing, reduced pressure, high pressure oxygen-enriched liquid bottoms, line 142. This at least partially vaporized stream can be then fed to medium pressure column 22. Note, in this case, it is not essential to feed any additional liquid on the boiling side from medium pressure column 22.

In the process of the present invention, the pressure of the low pressure distillation column can be close to atmospheric or higher; preferably, it will be less than 6 bara. Similarly, the pressure of the medium pressure column can be generally greater than 2.5 bara, preferably, greater than 4 bara, and the pressure of the high pressure column is generally greater than 4 bara, preferably, greater than 6 bara.

Figure 2:
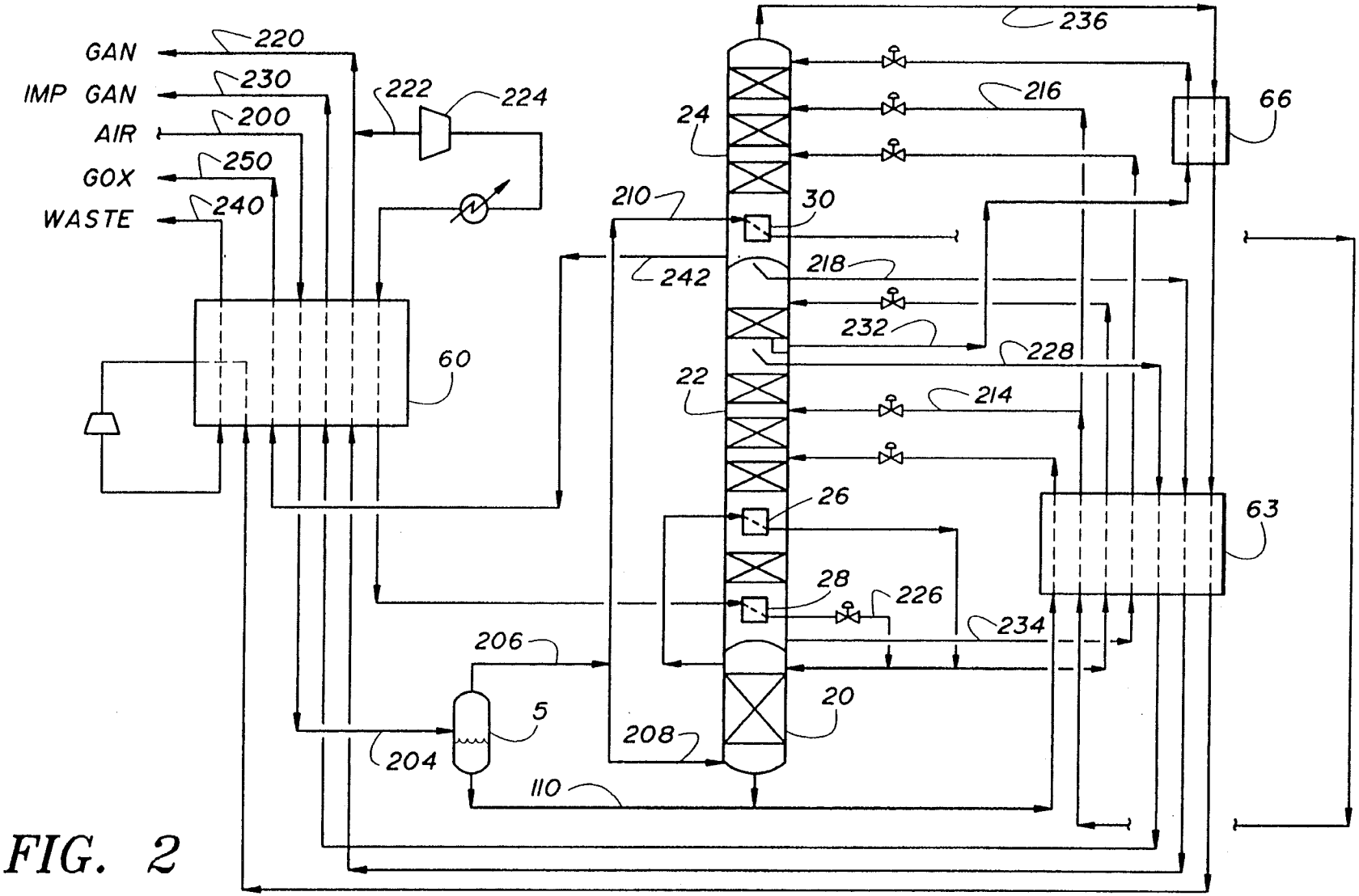

FIG. 2 is an example of the invention incorporating some of the options discussed above. The difference between the embodiment shown in FIG. 2 and shown in FIG. 1 is that low pressure column 24 and medium pressure column 22 are not thermally linked. Low pressure column 24 is boiled by a portion of the feed air, line 210. This option allows the low pressure column of FIG. 2 to be operated at a pressure higher than the low pressure column of FIG. 1, even if the feed air pressures for these two embodiments are the same. This may mean that the pressure of the low pressure column of FIG. 2 is significantly higher than the ambient pressure. The expansion of the vapor from the low pressure column can provide the needed refrigeration.

The streams of FIG. 2 are connected with the equipment items as follows. With reference to FIG. 2, the feed air, line 200, is cooled and partially condensed in main heat exchanger 60 and then sent to the phase separator 5. The vapor from phase separator 5, line 206, is split into lines 208 and 210. The vapor in line 208 is fed to the bottom of high pressure column 20. The high pressure oxygen-enriched bottoms liquid is mixed with the liquid from separator 5, line 110, and then subcooled in the warm section of the subcooler and fed to medium pressure column at 22 an intermediate position. The second portion of the vapor from the phase separator, line 210, is condensed in bottoms reboiler 30 of low pressure column 24, cooled in subcooler 63 and split into two streams, lines 214 and 216. The first liquid air substream, line 214, is reduced in pressure and fed to medium pressure column 22 on a tray below the liquid nitrogen reflux, but above the feed tray of the bottoms liquid from high pressure column 20. The second liquid air substream, line 216, is fed to low pressure column 24.

The streams produced by medium pressure column 22 are the medium pressure gaseous nitrogen overhead, line 218, the less pure medium pressure gaseous nitrogen, line 228, the impure liquid nitrogen, line 232, and the medium pressure oxygen-enriched bottoms liquid containing more than 40% of oxygen, line 234. Both the pure medium pressure gaseous nitrogen, line 218, and the less pure medium pressure gaseous nitrogen, line 228, are warmed in subcooler 63 and main heat exchanger 60, and delivered as product, via lines 220 and 230, respectively. A portion of the pure nitrogen product, line 222, is further compressed in compressor 224, aftercooled, cooled in main heat exchanger 60 and then condensed in bottoms reboiler 28 of medium pressure column 22. The liquid nitrogen thus produced, line 226, is used as the supplemental reflux to the high pressure column.

The other liquid air, line 216, and the oxygen-rich liquid, line 234, which are fed to low pressure column 24, are separated into a nitrogen-rich vapor exiting the top of the column, line 236, and the liquid oxygen, line 242, exiting the bottom. The nitrogen rich vapor is warmed in subcoolers 66 and 63 and main heat exchanger 60 to a midpoint, removed, expanded, and further warmed in main heat exchanger 60 and recovered as a nitrogen waste product, line 240. This nitrogen waste, line 240, can be used for air cleaning bed adsorbent regeneration or other purposes. The bottoms liquid oxygen 242 is vaporized and warmed to ambient temperature in main heat exchanger 60 and recovered as oxygen product, via line 250.

The present invention is particularly useful in applications where oxygen is used in the partial oxidation of a carbonaceous fuel to produce a fuel gas containing hydrogen and carbon monoxide. This fuel gas is then burned in a gas turbine combined cycle unit to generate electricity. Examples of hydrocarbons are coal, coke, oil, natural gas, etc. Oxygen can be used for coal gasification or partial oxidation of natural gas. Prior to combustion in the gas turbine, the fuel gas goes through a number of treatment steps. During these treatment steps, some constituents of the fuel gas may be recovered for alternative usage; a hydrogen byproduct may be recovered. The nitrogen gas from the current invention can be mixed with the fuel gas entering the gas turbine to increase motive flow and generate more power. Alternatively, the nitrogen gas can also be used as quench gas in the gasification plant or in the power turbine. In yet another alternative, it can also be mixed with the pressurized air to the combustor or injected separately into the combustor to control the final temperature and thereby limit NOx formation.

The present invention differs from the background art triple column cycle in that it is used for producing less than 98% purity gaseous oxygen production with no attempt to recover argon, and in that it generates more than 35% of the total air feed as nitrogen from the high and medium pressure columns. There is at least one feed to the low pressure column which has generally more than 40% and preferably more than 50% oxygen. It differs from the other cycles producing less than 98% purity oxygen in that it has three columns. The efficacy of this invention can be demonstrated by the following example.

EXAMPLE

Calculations were performed for the process of the present invention as depicted in FIG. 1 to produce oxygen at a desired purity of 95% and a nitrogen stream with less than 10 vppm oxygen. The following table shows the results of those calculations.

| Stream Number | Pressure (psia) | Temperature (°F.) | Flow Rate (lbmol/hr) | Composition Oxygen (vol %) [vppm] | Composition Nitrogen (vol %) [vppm] |
|---|---|---|---|---|---|
| 100 | 110 | 77 | 100 | 20.95 | 78.12 |
| 108 | 108 | −266.7 | 65.72 | 20.95 | 78.12 |
| 172 | 61.1 | 72.13 | 55.36 | [6.7] | 99.94 |
| 186 | 40.3 | 72.13 | 21.85 | 95.15 | 1.89 |
| 157 | 137 | 77 | 29 | [6.7] | 99.94 |

It is seen from this example that not only very high recovery of oxygen (99.24% of the oxygen in the feed air stream) is achieved but also a large fraction of the feed air (more than 55% of the feed air) is recovered as nitrogen product at substantially high pressure. This not only makes the process quite efficient but also saves on the nitrogen product compressor. Generally, nitrogen is needed at a much higher pressure. If nitrogen is produced from a conventional double column cycle, then it is impossible to produce a large fraction of nitrogen at a pressure substantially higher than atmospheric pressure. In the conventional double column cycle, nitrogen is produced at a lower pressure from the low pressure column and additional compression stages would be needed to compress nitrogen to about 4 bara.

The present invention has been described with reference to two specific embodiments thereof. These embodiments should not be viewed as a limitation on the scope of the invention; the scope of which should be ascertained from the following claims.

We claim:

1. A process for the separation of a compressed feed air stream to produce gaseous oxygen with purity less than 98% and nitrogen with high recoveries comprising:

(a) using three distillation columns consisting of a low pressure column, a medium pressure column which operates at a pressure higher than the low pressure column and a high pressure column which operates at a pressure higher than the medium pressure column;

(b) feeding a portion of the compressed feed air stream to the high pressure column for distillation into a high pressure oxygen-enriched liquid bottoms and a high pressure nitrogen overhead;

(c) feeding at least a portion of the high pressure oxygen-enriched liquid bottoms to the medium-pressure column;

(d) condensing at least a portion of the high pressure nitrogen overhead by heat exchange against a liquid stream of the medium pressure column and using at least a portion of the condensed high pressure nitrogen to provide reflux to the high pressure column;

(e) removing a medium-pressure oxygen-enriched liquid from the medium pressure column at a location below the high pressure oxygen-enriched liquid bottoms feed point and feeding the removed, medium-pressure oxygen-enriched liquid to an intermediate point of the low pressure column for distillation;

(f) producing at least a portion of the oxygen product from the bottom of the low pressure column; and (g) recovering greater than 35% of the feed air flow to the distillation column system as nitrogen product wherein the nitrogen product is recovered from the high pressure column, the medium pressure column or both the high pressure and medium pressure columns.

2. The process according to claim 1 wherein the portion of the high pressure nitrogen overhead stream in step (d) is condensed by heat exchange with a liquid at an intermediate location of the medium pressure column.

3. The process according to claim 2 wherein the boilup at the bottom of the medium pressure column is produced by the condensation of a suitable process stream.

4. The process according to claim 3 wherein the suitable process stream to be condensed is a nitrogen stream at a pressure higher than that of the high pressure column.

5. The process according to claim 4 wherein product oxygen is withdrawn as liquid from the bottom of the low pressure column, and then boiled by heat exchange with a suitable process stream.

6. The process in claim 5 wherein heat exchange is provided by the total condensation of a portion of the feed air stream.

7. The process in claim 6 wherein prior to heat exchange product liquid oxygen is boosted to a higher pressure.

8. The process in claim 5 wherein heat exchange is provided by the partial condensation of a portion of the feed air stream.

9. The process according to claim 4 wherein the medium pressure oxygen-enriched liquid in step (e) is produced at the bottom of the medium pressure column.

10. The process according to claim 4 wherein the medium pressure oxygen-enriched liquid in step (e) is produced from an intermediate location of the medium pressure column.

11. The process according to claim 4 wherein a nitrogen-rich liquid stream is withdrawn from the medium pressure column at a location above the feed point of the high pressure oxygen-enriched liquid bottoms and is fed as reflux to the low pressure column.

12. The process according to claim 4 wherein a gaseous nitrogen product stream is produced from the top of the medium pressure column.

13. The process according to claim 12 wherein another nitrogen-enriched stream is withdrawn as coproduct from an intermediate location of the medium pressure column.

14. The process according to claim 4 wherein the boilup at the bottom of the low pressure column is provided by the condensation of a suitable process stream.

15. The process according to claim 14 wherein the condensing process stream is a nitrogen stream.

16. The process according to claim 15 wherein the condensing nitrogen stream is a fraction of the nitrogen from the top of the medium pressure column.

17. The process according to claim 1 wherein product oxygen is withdrawn as liquid from the bottom of the low pressure column, boosted in pressure and then boiled by heat exchange with a suitable process stream.

18. The process in claim 17 wherein heat exchange is provided by the total condensation of a portion of the compressed feed air stream.

19. The process in claim 17 wherein heat exchange is provided by the partial condensation of a portion of the feed air stream.

20. The process according to claim 1 wherein the medium pressure oxygen-enriched liquid in step (e) is produced at the bottom of the medium pressure column.

21. The process according to claim 1 wherein the medium pressure oxygen-enriched liquid in step (e) is produced from an intermediate location of the medium pressure column.

22. The process according to claim 21 wherein an oxygen product stream is produced from the bottom of the medium pressure column.

23. The process according to claim 1 wherein the nitrogen product produced in step (g) is sent to an integrated gasification electric power generation system.

24. The process according to claim 1 wherein the nitrogen product produced in step (g) is returned to an integrated gasification electric power generation system.

25. The process according to claim 1 wherein the liquid stream of the medium pressure column in step (d) is the high pressure oxygen-enriched liquid bottoms to be fed to the medium pressure column which has had its pressure reduced to a pressure at or near the pressure of the medium pressure column and the reduced pressure, oxygen-enriched liquid bottoms is at least partially vaporized.

26. The process according to claim 25 wherein the reboiler/condenser used for vaporizing the reduced pressure, high pressure oxygen-enriched liquid bottoms is located external to the medium pressure column.

* * * * *